United States Patent [19]

Maeda et al.

[11] Patent Number: 4,952,986

[45] Date of Patent: Aug. 28, 1990

[54] COPYING APPARATUS

[75] Inventors: Yasutaka Maeda, Ikoma; Hideyuki Nishimura, Yamatokoriyama; Tsuyoshi Miyamoto, Osaka; Kyouichi Takata, Yamatokoriyama; Kiyoshi Inamoto, Sakai; Kazuyuki Ohnishi, Nara; Kazunori Sohda, Nara; Yukihiko Ueno, Hirakata; Taisuke Kamimura, Nara; Yoichi Shimazawa, Nara; Tokiyuki Okano; Masato Tokishige, both of Yamatokoriyama, all of Japan

[73] Assignee: Sharp Kabushiki Kaisha, Osaka, Japan

[21] Appl. No.: 330,367

[22] Filed: Mar. 29, 1989

[30] Foreign Application Priority Data

| | | | |
|---|---|---|---|
| Mar. 29, 1988 | [JP] | Japan | 63-77617 |
| Apr. 20, 1988 | [JP] | Japan | 63-97497 |
| May 17, 1988 | [JP] | Japan | 63-119934 |

[51] Int. Cl.[5] ..... G03G 15/00

[52] U.S. Cl. ..... 355/208; 355/214; 355/246; 355/326

[58] Field of Search ..... 355/208, 214, 246, 219, 355/221, 225, 326, 327; 358/285, 286

[56] References Cited

U.S. PATENT DOCUMENTS

| | | | |
|---|---|---|---|
| 4,551,005 | 11/1985 | Koichi | 355/214 |
| 4,624,547 | 11/1986 | Endo et al. | 355/214 X |
| 4,624,548 | 11/1986 | Takayanagi | 355/214 X |
| 4,627,713 | 12/1986 | Abuyama | 355/214 X |
| 4,662,738 | 5/1987 | Kasuya | 355/208 |
| 4,674,863 | 6/1987 | Tamesada et al. | 355/214 X |
| 4,684,239 | 8/1987 | Takayanagi et al. | 355/214 |
| 4,702,590 | 10/1987 | Usami | 355/214 |
| 4,733,276 | 3/1988 | Kakitani | 355/246 X |
| 4,745,434 | 5/1988 | Shimomura et al. | 355/214 X |
| 4,812,881 | 3/1989 | Kumamoto et al. | 355/208 X |
| 4,860,059 | 8/1989 | Terashita | 355/208 X |

*Primary Examiner*—R. L. Moses

[57] ABSTRACT

A copying apparatus having a prescanning function for obtaining density data to adjust copy parameters includes a correction function which eliminates the data obtained from a portion of a predetermined color, from the density data detected on a prescanning process. The density data can be restricted within a predetermined range. The predetermined range can be easily set by the user.

10 Claims, 10 Drawing Sheets

COPYING APPARATUS

BACKGROUND OF THE INVENTION

1. Field of the invention:

This invention relates to an image processing apparatus such as a copying apparatus and image reading apparatus. More particularly, it relates to a copying apparatus comprising a density detection device for detecting the density of an original to be copied, in a process of prescanning the original, and an adjusting means for adjusting at least one of the conditions of copying the original, on the basis of a group of detected density data.

2. Description of the prior art:

In a copying apparatus, the copy density (contrast) is adjusted by controlling one or more copy parameters such as the voltage level applied to the exposure lamp and the potential of the photosensitive body, in accordance with the density of an original to be copied. Usually, the density of an original is detected by prescanning the original to automatically adjust the density of a copy of the original. More specifically, an original is scanned by the light of an exposure lamp before the actual copy process, so that the light reflected from the original impinges on a photosensor. The data corresponding to the density of various portions of the original (density data) are obtained from the sensor. One or more of the above-mentioned copy parameters are automatically adjusted on the basis of the accumulated value, a mean value, maximum value or minimum value of these density data, thereby enabling improvement of the image quality of a copy which will be obtained in the subsequent copying process. Then, the actual copying process is performed under the thus adjusted parameters.

In a practical use, however, a copying apparatus must copy a very wide variety of originals, and therefore each copying apparatus must cope with several kinds of originals. Particularly, it is more usual for a color copying apparatus to deal with an original having black areas (such as photographs) than an original having lines (such as characters) only. When copying an original in the form of a thick book, moreover, it is often that the copy process is conducted without covering the original (i.e., without using an original cover), to facilitate the handling the original, which results in portions outside the original being detected as black areas. In these cases, the density data obtained in a prescanning process includes those obtained from black areas or blank areas caused by the nonuse of an original cover, resulting in the density data failing to correspond to the actual density of the original. Namely, when an arithmetic mean value of the density data is used (mean value method), the mean value is biased toward a black tone so that the following copying process cannot be conducted properly (the density of the resulting copy is too low).

Moreover, a copying apparatus using the mean value method often fails to detect properly the density of an original. For example, when an original having a wide white background is to be copied, the mean value of the density data represents a smaller value than that which is necessary for a proper copy of the original, resulting in obtaining a copy in which the image area, which is most important, becomes too thick in density. In order to overcome this disadvantage, an improved copying apparatus has been developed. In an improved apparatus, the density data obtained from areas of an original, the density of which is greater than an upper threshold level or less than a lower threshold level, are eliminated from the density data to be further processed, so that the copying parameters are adjusted on the basis of only the density data obtained from the intermediate density areas of the original.

In such an improved copying apparatus, however, those upper and lower threshold levels are preset at fixed values during manufacture of the apparatus in a factory. Unevenness in the light strength of an exposure lamp or in the sensitivity of a photosensor and the deterioration of the sensitivity may cause the data obtained from an intermediate density area to be deviated toward either of the darker and brighter densities. This deviation of the intermediate density area makes the density detection performed in a prescanning process entirely useless, especially when an original having pale or thick density images is to be copied. In this way, a prior art copying apparatus having the density detection device has the problem that it cannot detect accurately the density of an original, depending on the variation of the characteristics in each apparatus or on the kind of the original. Even if it is designed so as to allow the correction of the threshold values, the prior art still involves the problem that it is necessary to verify the correction by performing a test copy, causing a prolonged time for the correction and wasted copy paper.

Further, such a conventional copying apparatus has a further problem as described below. A photosensor such as a photo transistor has a light receiving face F of a few millimeters in diameter (FIG. 11(B)). When an original B is to be copied wherein, as shown in FIG. 11(C), the image density suddenly changes from black to white (i.e., there is no intermediate density area between the black area B1 and the white area B2), the output of the sensor moving in the direction of the arrow (FIG. 11(B)) varies as indicated in FIG. 11(A) from a value corresponding to black to another value corresponding to white, following a curve containing intermediate values corresponding to half tones. This is because the light receiving face F extends over both the black area B1 and the white area B2 during when the light receiving face F moves from a first position T1 to a second position T2. Namely, the output of the sensor is affected by both the black and white areas B1 and B2 during when the light receiving face F moves between the positions T1 and T2. This is also applicable in the case that either of the black and white areas is replaced with a photograph having an intermediate density. In this case, the photograph borders the black area or white area so that the density data obtained immediately before and after the border contains large errors.

The above will be described more specifically. As shown in FIG. 12(A), an original C having photographs 51 and 52 and white areas 53 to 55 surrounding the photographs is placed on an original table 2. One example of the actual image density data of such an original is shown in FIG. 12(B). When the original is prescanned, the density data obtained as outputs of the sensor will be represented by a distorted waveform as shown in FIG. 12(C). In FIGS. 12(B) and 12(C), the one dot chain lines represent the upper and lower threshold levels of the density data, respectively. When only the density data existing between the upper and lower threshold levels are considered (i.e., density data corresponding to black and white are eliminated from the density data of (FIG. 12(C)), it will be easily seen that the density data obtained immediately before and after the borders have extremely appreciable errors. Hence, a prior art copying apparatus has a drawback in that density data containing errors are utilized to cause an imprecise control of the copying parameters.

The above-mentioned difficulties of a prior art copying apparatus are applicable also to another image processing apparatus, that of an image reading apparatus such as an image scanner.

SUMMARY OF THE INVENTION

The copying apparatus of this invention, which overcomes the above-discussed and numerous other disadvantages and deficiencies of the prior art, comprises a density detection device for detecting the density of an original to be copied, in a process of prescanning the original, and an adjusting means for adjusting at least one of the conditions of copying the original, on the basis of a group of detected density data, said apparatus further comprises a correction means which eliminates the data obtained from a portion of a predetermined color, from said group of detected density data.

In a preferred embodiment, the predetermined color is black.

The copying apparatus comprises a density detection device for detecting the density of an original to be copied, in a process of prescanning the original, and an adjusting means for adjusting at least one of the conditions of copying the original, on the basis of a group of detected density data which exist between two predetermined values, said apparatus further comprises: a detection means which detects the density of a first reference original having a dark color and the density of a second reference original having a bright color; and a density storage means for storing said two densities detected by said detection means as said two predetermined values.

The copying apparatus comprises a density detection device for detecting the density of an original to be copied, in a process of prescanning the original, and an adjusting means for adjusting at least one of the conditions of copying the original, on the basis of a group of detected density data, said apparatus further comprises: a judging means which judges whether density data obtained from portions of the original exist between two predetermined values or not; and a correction means which eliminates, from said group of detected density data, extreme density data which exist beyond the range between said two predetermined values.

In a preferred embodiment, the correction means further eliminates density data which are obtained during a predetermined time period including the time when each of said extreme density data is obtained.

The image reading apparatus comprises a density detection device for detecting the density of an image to be read, in a process of prescanning the image, and an adjusting means for adjusting at least one of the conditions of reading the image, on the basis of a group of detected density data, said apparatus further comprises a correction means which eliminates the data obtained from a portion of a predetermined color, from detected density data.

The image reading apparatus comprises a density detection device for detecting the density of an image to be read, in a process of prescanning the image, and an adjusting means for adjusting at least one of the conditions of reading the image, on the basis of a group of detected density data which exist between two predetermined values, said apparatus further comprises: a detection means which detects the density of a first reference image having a dark color and the density of a second reference image having a bright color; and a density storage means for storing said two densities detected by said detection means as said two predetermined values.

The image reading apparatus comprises a density detection device for detecting the density of an image to be read, in a process of prescanning the image, and an adjusting means for adjusting at least one of the conditions of reading the image, on the basis of a group of detected density data, said apparatus further comprises: a judging means which judges whether density data obtained from portions of the image exist between two predetermined values or not; and a correction means which eliminates, from said group of detected density data, extreme density data which exist beyond the range between said two predetermined values.

In a preferred embodiment, the correction means further eliminates density data which are obtained during a predetermined time period including the time when each of said extreme density data is obtained.

Thus, the invention described herein makes possible the objectives of:

(1) providing an image processing apparatus which cam properly control the image processing parameters;

(2) providing a copying apparatus which can properly control the copy parameters;

(3) providing a copying apparatus which can eliminate unnecessary data originated in a predetermined color (e.g., black) area from the density data so as to optimize the control of the copy parameters;

(4) providing a copying apparatus by which the threshold values for controlling the copy parameters can be easily preset;

(5) providing a copying apparatus which can properly detect the density of an original in accordance with the variations in characteristics of the apparatus or with the kind of the original;

(6) providing a copying apparatus in which it is not necessary to verify the correction by performing a test copy, without causing a prolonged time for the correction and wasted copy paper; and (7) providing a copying apparatus which can control the copying parameters on the basis of correct and effective density data only; and (8) providing a copying apparatus which can eliminate adverse effects caused by borders between black or white areas and photographs.

BRIEF DESCRIPTION OF THE DRAWINGS

This invention may be better understood and its numerous objects and advantages will become apparent to those skilled in the art by reference to the accompanying drawings which are given by way of illustration only, and thus are not limitative of the present invention, and wherein.

DESCRIPTION OF THE PREFERRED EMBODIMENTS

EXAMPLE 1

Figure 1:
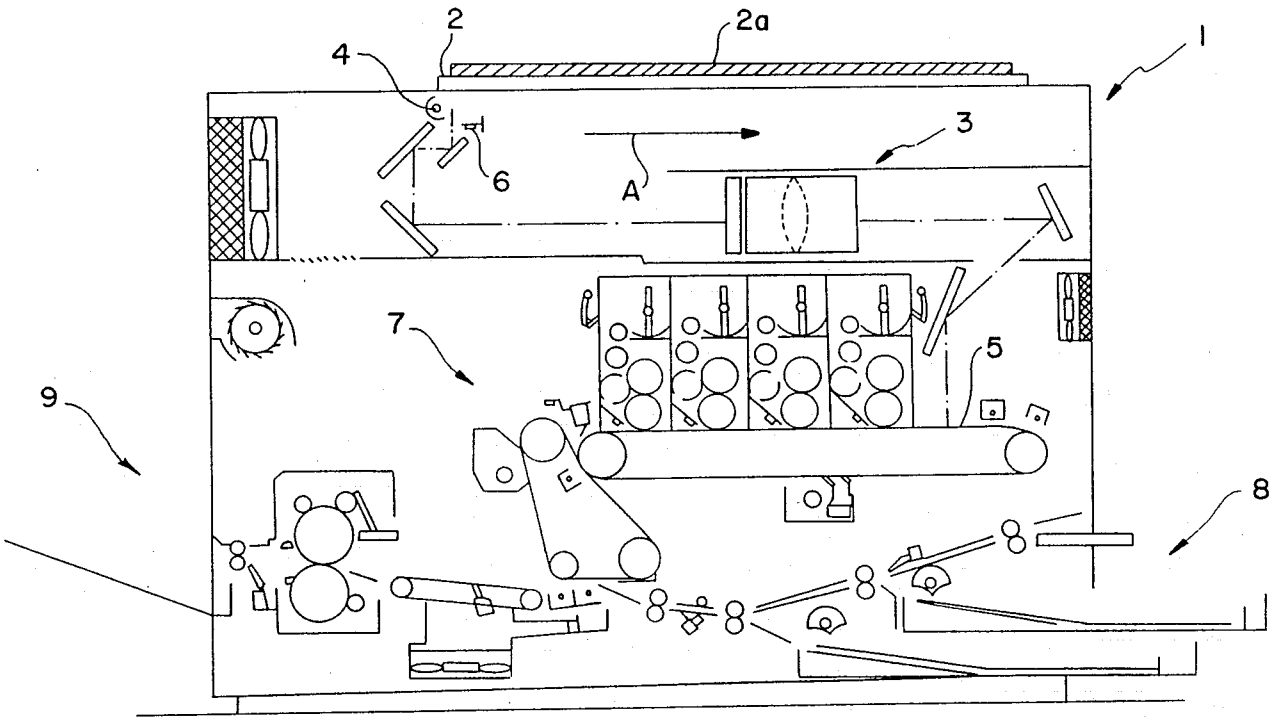
FIG. 1 shows a diagrammatic cross sectional view of a copying apparatus according to an embodiment of the present invention.

FIG. 1 shows diagrammatically a color copying apparatus according to an embodiment of the present invention. An original table 2 and an original cover 2*a* are provided on the top of the housing 1 of the copying apparatus. Under the original table 2 is disposed an optical system 3 which projects the light of an exposure lamp 4 to an original placed on the original table 2 and guides the light reflected from the original to the image projection area of a belt-like photosensitive body 5. An optical sensor 6 is disposed in the vicinity of the exposure lamp 4. The sensor 6 and the lamp 4 are mounted on a scanning unit (not shown) and moved to scan the original along the directions indicated by the arrow A so that the sensor 6 receives sequentially the light reflected from each portions of the original.

The photosensitive body 5 constitutes a part of an electrophotographic unit 7 for color copying. A paper feed unit 8 is disposed on one side of the housing 1, and a paper exit unit 9 on the opposite side of the housing. A sheet of paper fed from the paper feed unit 8 is moved to the electrophotographic unit 7 where the image of the original is transferred to the paper, then the paper is discharged to the paper exit unit 9.

Figure 2:
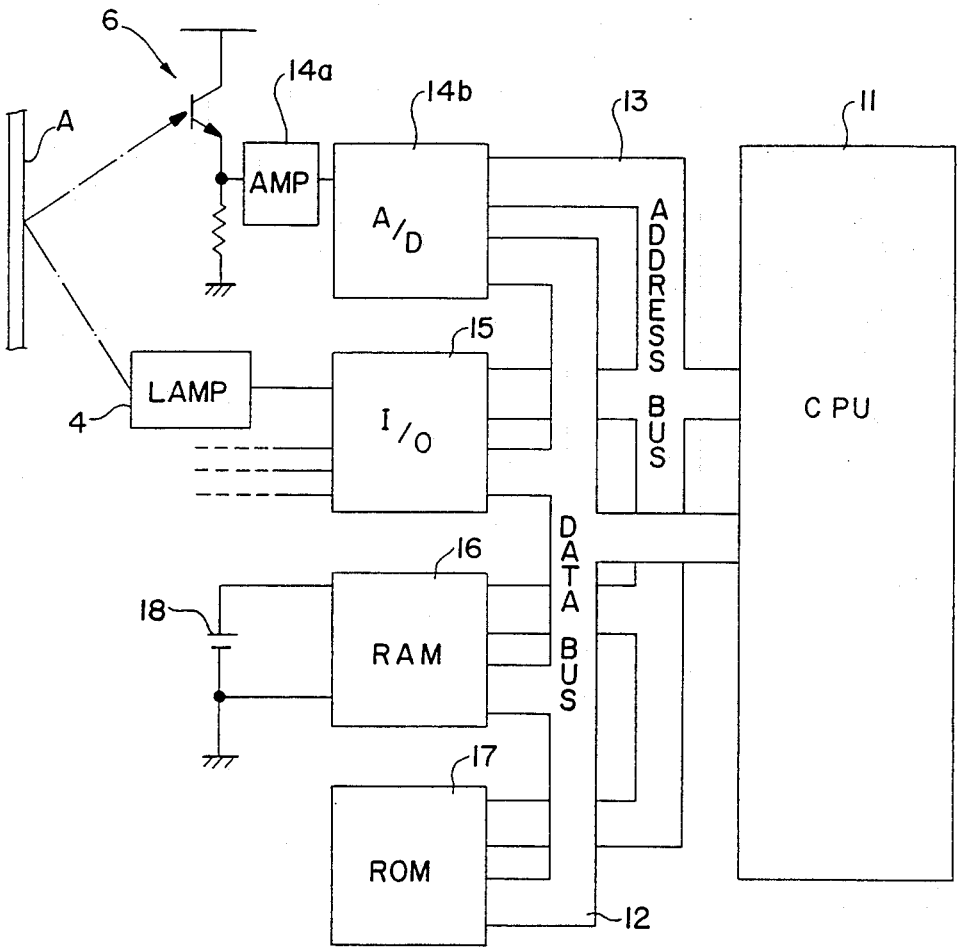
FIG. 2 is a block diagram of the control unit of the apparatus of FIG. 1.

FIG. 2 illustrates diagrammatically the control unit of the copying apparatus. In the control unit, a CPU 11 is connected to an A/D converter 14*b*, an I/O interface 15, a RAM 16 and a ROM 17 via data bus 12 and an address bus 13. The ROM 17 stores the program for operating the CPU 11. The RAM 16 is backed up by a battery 18, and stores density data as described later.

Figure 3:
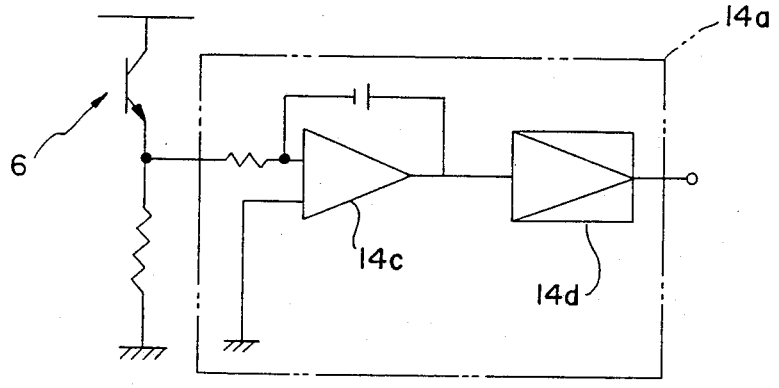
FIG. 3 is a block diagram of an amplifier used in the apparatus of FIG. 1.

The exposure lamp 4 is connected to the I/O interface 15 so that the lighting of the exposure lamp 4 and the exposure voltage are controlled by the CPU 11. The sensor 6 is connected to the A/D converter 14*b* through an amplifier 14*a*. FIG. 3 shows the amplifier 14*a* in more detail. The output of the sensor 6 is integrated by an integrator 14*c* to such a degree that the variation in the output becomes smooth. The output of the integrator 14*c* is amplified by the amplifying circuit 14*d*, and then supplied to the CPU 11 via the A/D converter 14*b*. When the original A is prescanned to obtain the density data, the exposure lamp 4 lights under the control of the CPU 11, and the optical sensor 6 receives the light reflected from the original A. The output of the sensor 6 is supplied to the CPU 11 to obtain digital data concerning the density of the original A.

Figure 4A:
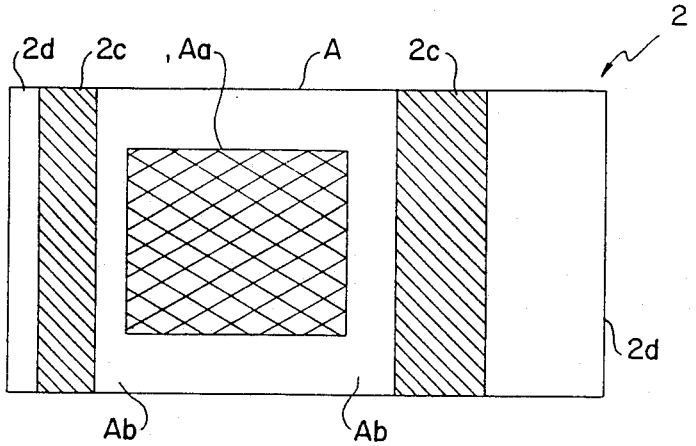
FIG. 4(A) is a diagram illustrating a manner of placing an original on an original table.
Figure 4B:
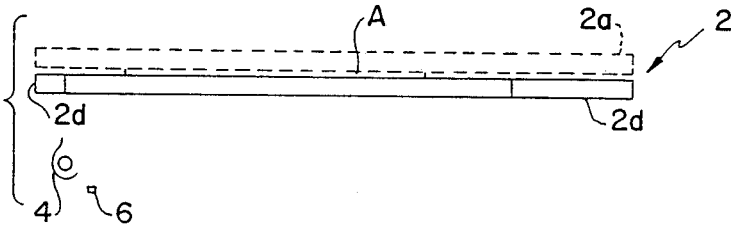
FIG. 4(B) is a cross sectional view of FIG. 4(A)
Figure 4C:
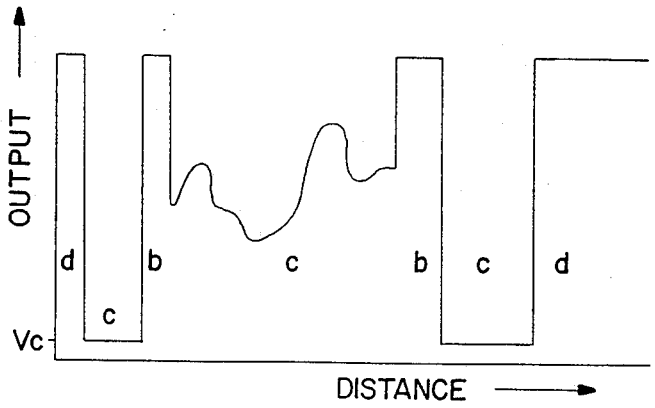
FIG. 4(C) is a graph showing the output of the amplifier in a conventional apparatus.

With reference to FIG. 4, the relation between the original A and the output of the amplifier 14*a* in the prescanning will be described. FIG. 4(A) shows the original A placed on the original table 2 with the original cover 2*a* opened. The original A consists of white paper Ab and a photograph or illustration Aa pasted on the paper Ab. On the both sides of the original A, portions 2*c* of the original table 2 are exposed. The both ends of the original table 2 constitute areas 2*d* for pressing a wide original. FIG. 4(C) shows a waveform of the output of the amplifier 14*a* when the original A is prescanned. In FIG. 4(C), the ordinate represents the output of the amplifier 14*a*, and the abscissa represents the distance which the sensor 6 has moved from the home position indicated in FIG. 4(B). In this embodiment, the sensor 6 is positioned near the middle of the lamp 4 to move along the center axis of the original table 2 elongating perpendicular to the scanning direction. The areas b in FIG. 4(C) where the output level is high correspond to the white areas Ab of the original A, and the area a correspond to the photograph Aa. The areas c where the output level is very low ($V_c$) correspond to the portions 2*c* which are black areas. The areas d where the output level is high as in the areas b correspond to the original pressing area 2*d*. In this embodiment, as described above, the output of the sensor 6 is supplied to the CPU 11 while being integrated. If there is not a black area in the photograph Aa (namely, there is no continuously extending black area), therefore, the output level in the area a never falls to the level in the area c (i.e., $V_c$). Conversely, if there is a black area in the photograph Aa, the portion of the area a corresponding to the black area falls to the output level of $V_c$.

Figure 5:
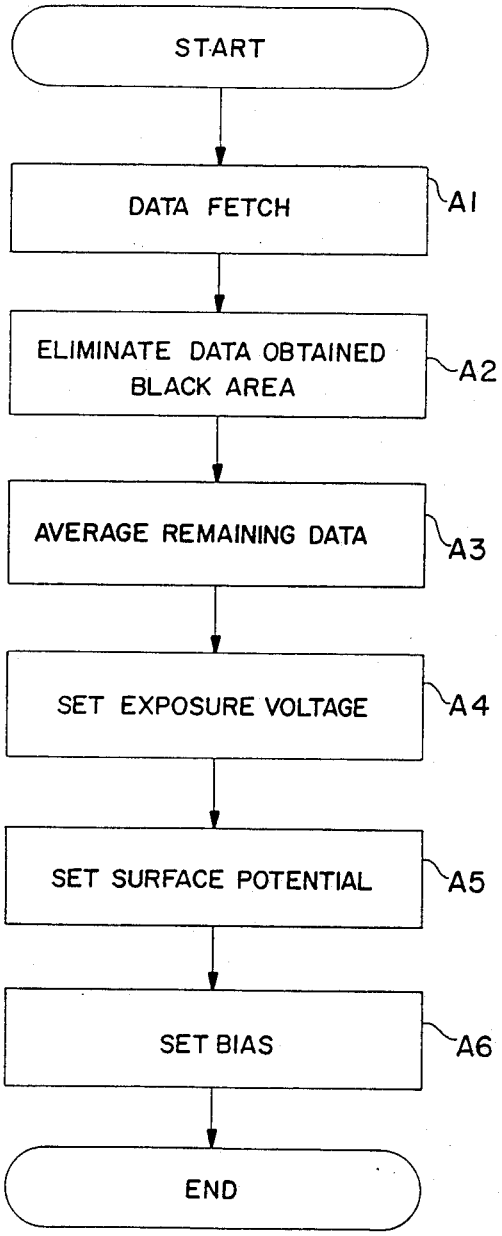
FIG. 5 is a flow chart of the prescanning process of an embodiment of the invention.

According to this embodiment, the copy parameters are adjusted on the basis of the density data which are obtained by eliminating the data corresponding to black areas from data accumulated in the prescanning, as described below. FIG. 5 is a flow chart of the operation of the CPU 11 in the prescanning process. The output data of the sensor 6 are sent to the CPU 11, and stored in the RAM 16 (step Al). Data corresponding to a black area (i.e., data the level of which is $V_c$) are eliminated from the stored data (step A2). The average of the remaining data is calculated (step A3). The copy parameters such as the level of the exposure voltage, the surface potential of the photosensitive body 5 and the bias voltage are adjusted in accordance with the thus obtained average of the density data (steps A4 to A6). Then, a copying process is conducted under the adjusted conditions.

EXAMPLE 2

Figure 8:
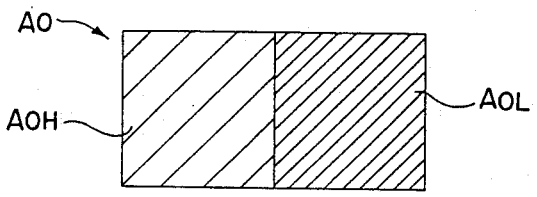
FIG. 8 shows a reference original used in the embodiment of FIG. 6.
Figure 6:
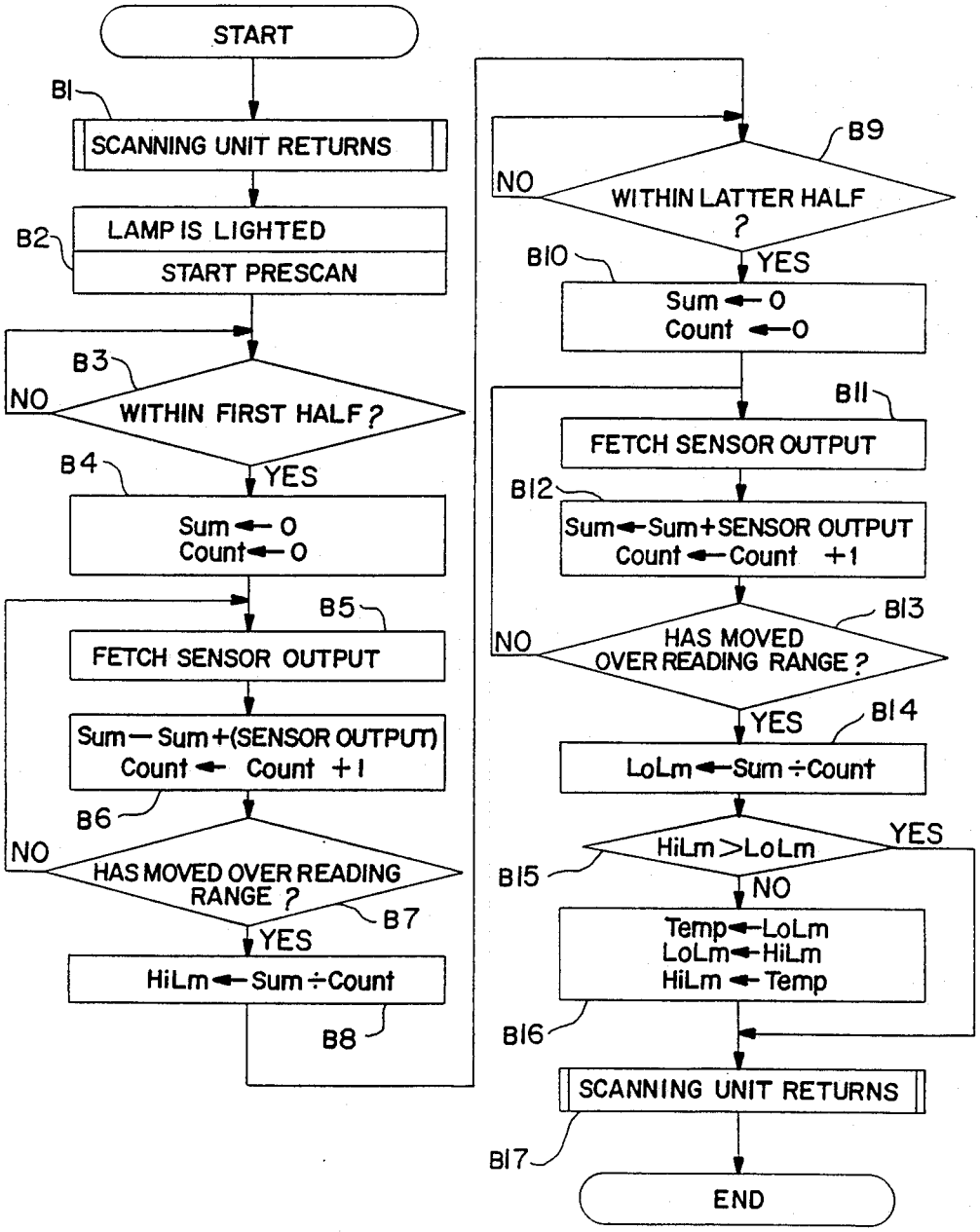
FIG. 6 is a flow chart of the prescanning process of another embodiment of the invention.

FIG. 6 is a flow chart of setting threshold density level according to a second embodiment of the invention. A reference original $A_O$ shown in FIG. 8 is placed on the original table 2. The reference original $A_O$ is of A4 size and divided into two sections $A_{OH}$ and $A_{OL}$. The first section $A_{OH}$ formed in the first half of the original $A_O$ has the lowest density which can be recognized as an image area by the density detection system. The second section $A_{OL}$ formed in the latter half of the original has the highest density which can be recognized as an image area by the density detection system. The reference original $A_O$ having such a configuration may be supplied for each copying apparatus as required, or alternatively, the user may prepare such a reference original according to the conditions of the actual use of his copying apparatus.

In step B1, the scanning unit on which the exposure lamp 4 and the sensor 6 are mounted returns to its home position. Then, the lamp 4 is lighted by applying an exposure voltage of 70 V, and the scanning unit begins to move in the direction A (step B2). In this prescanning process, the operation of reading the density is delayed by a predetermined time (step B3) and terminated in advance of the end of the white area $A_{OH}$, so that the reading of the density is restricted within a predetermined range (hereinafter, referred to as "reading range") which is narrower than the white and black areas $A_{OH}$ and $A_{OL}$, thereby preventing errors from appearing in the data obtained in the edge portions of the black and white areas. When the scanning unit reaches the reading range of the first half $A_{OH}$, the storage areas Sum and Count in the RAM 16 are cleared to be initialized (step B4). The output of the sensor 6 is supplied to the CPU 11 through the A/D converter 14*b* (step B5) to be sampled. The sampled data from the sensor 6 is added to the contents of the storage area Sum, and the contents of the storage area Count are incremented (step B6). In step B7, it is checked whether the scanning unit has moved over the reading range of the first half $A_{OH}$ or not. When the scanning unit is still within the reading range, the process of step B5 is repeated until the scanning unit reaches the end of the reading range. When the scanning unit has moved over the reading range, the calculation of [Sum÷Count] is conducted, and the quotient, which means the average of the density data obtained in the first half or white area $A_{OH}$, is stored in a storage area HiLm of the RAM 16 which stores the threshold density values for a pale color (pale-side threshold value) (step B8).

After the process for the first half $A_{OH}$ has been completed, the system waits till the scanning unit reaches the reading range of the latter half $A_{OL}$ (step B9). When the scanning unit reaches the reading range of the latter half $A_{OL}$, the storage areas Sum and Count are cleared to be initialized (step B10). The output of the sensor 6 is supplied to the CPU 11 through the A/D converter 14*b* to be sampled (step B11). The sampled data from the sensor 6 are added to the contents of the storage area Sum, and the contents of the storage area Count is incremented (step B12). In step B13, it is checked whether the scanning unit has moved over the reading range of the latter half $A_{OL}$ or not. When the scanning unit is still within the reading range, the process of step B11 is repeated until the scanning unit reaches the end of the reading range of the latter half $A_{OL}$. When the scanning unit has moved over the reading range, the calculation of [Sum÷Count] is conducted, and the quotient, which is the average of the density data obtained in the latter half or black area $A_{OL}$, is stored in a storage area LoLm of the RAM 16 which stores the threshold density value for a thick color (thick-side threshold value) (step B14).

After the reading ranges of both the white and black areas have been scanned, the contents of the storage areas HiLm and LoLm are compared with each other (step B15). As described above, the reference original $A_O$ is placed so that the white area $A_{OH}$ and the black are $A_{OL}$ are scanned in this sequence. Hence, the contents of the storage area HiLm are always greater than those of the storage area LoLm. If the reference original $A_O$ is placed in a positionally reversed manner, i.e., the original $A_O$ is placed so that the black area $A_{OL}$ is scanned first, the relation between the values HiLm and LoLm is reversed, resulting in that, as will be apparent later, the density data of an original to be copied cannot be detected. To avoid this difficulty, the contents of the storage area HiLm is swapped with those of the storage area LoLm using a temporary storage area Temp, when the contents of the storage area HiLm is not greater than those of the storage area LoLm (step B16).

After the two threshold density values (pale-side and thick-side threshold values) have been set in this way, the scanning unit returns to the home position (step B17). These threshold density values stored in the RAM 16 are retained even when the power of the copying apparatus is off.

Figure 7:
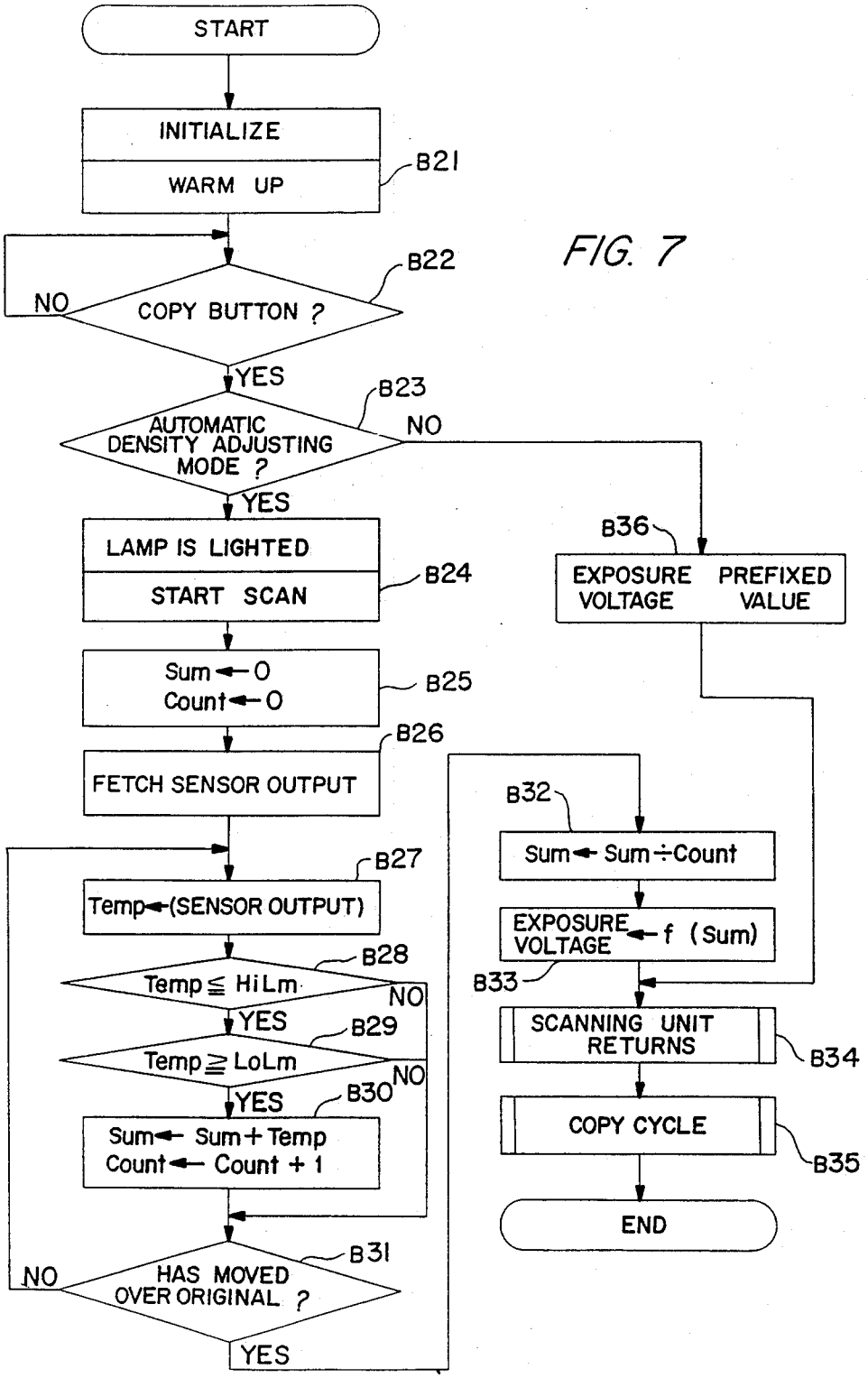
FIG. 7 is a flow chart of the copy process of the embodiment of FIG. 6.

The operation of a copy process in the copying apparatus in which the threshold density values have been thus preset will be described with reference to FIG. 7. When the copying apparatus is turned on, the apparatus is initialized and warmed up (step B21), and waits for the depress of a copy button (not shown) (step B22). When an original to be copied is placed on the original table 2 and the copy button is depressed, it is checked whether the automatic density adjusting mode has been selected or not (step B23).

When the automatic density adjusting mode has been selected, the lamp 4 is lighted by applying an exposure voltage of 70 V, and the scanning unit begins to move to scan the original (step B24). The storage areas Sum and Count are cleared to be initialized (step B25). The output of the sensor 6 is supplied to the CPU 11 through the A/D converter 14*b* (step B26) to be sampled. The sampled datum from the sensor 6 is temporarily stored in the storage area Temp (step B27). The value stored in the storage area Temp is compared with the pale-side threshold value which has been stored in the storage area HiLm (step B28), and also with the thick-side threshold value which has been stored in the storage area LoLm (step B29). When the value stored in the storage area Temp is between the threshold values stored in the storage areas HiLm and LoLm, it is added to the contents of the storage area Sum, and the contents of the storage area Count is incremented (step B30). Hereinafter, the area of the original from which the output existing between the two threshold values is referred to "image area". In step B31, it is checked whether the scanning unit has moved over the original or not. When the value stored in the storage area Temp is judged in step B27 to be greater than the pale-side threshold value stored in the storage area HiLm, or when the value stored in the storage area Temp is judged in step B29 to be smaller than the thick-side threshold value stored in the storage area LoLm, the process proceeds to step B31, skipping step B30. If it is judged in step B31 that the scanning unit has not yet moved over the original, the process returns to step B27 to repeat the above-mentioned procedures. Thus, only when the output of the sensor 6 is between the thick-side threshold value and the pale-side threshold value (namely, the image area has been scanned), this loop allows the output of the sensor 6 to be added to the contents of the storage area Sum.

When it is judged in step B31 that the scanning unit has moved over the original, the calculation of [Sum÷Count] is conducted, and the quotient, which is the average of the density data obtained from the image area, is stored in the storage area Sum of the RAM 16 (step B32). The exposure voltage is adjusted to comply with the value stored in the storage area Sum.

In this way, the automatic adjustment of copy density is conducted by setting the image area on the basis of the values which have been stored in the storage areas HiLm and LoLm of the RAM 16 as threshold density values, resulting in eliminating the adverse effects on the copy quality caused by the variations in the characteristics of an individual copying apparatus. The user may suitably select or prepare the reference original $A_o$ so that the image area (i.e., the range between the threshold density values) can be adequately preset to meet the kind of an original to be copied.

After the level of the exposure voltage is set in step B32, the scanning unit returns to the home position (step B34). Then, the copy cycle for copying the original starts (step B35). In this copy cycle, voltage the level of which has been set in step B33 is applied to the exposure lamp 4 so as to obtain a copy the density of which is properly adjusted in accordance with the conditions of the original.

If the automatic density adjusting mode has not been selected, the process proceeds from step B23 to step B36 to set the level of the exposure voltage to a value which has been preset by the operator, and the process further proceeds to step B34 to return the scanning unit to the home position. In this case, the level of the exposure voltage is not always an optimal one, which may cause a copy of an insufficient quality.

In this example, a single reference original having white and black areas is used for adjusting the threshold density values. Alternatively, two reference original having a different color may be used. In this case, the prescanning process is conducted for each reference original.

EXAMPLE 3

Figure 9:
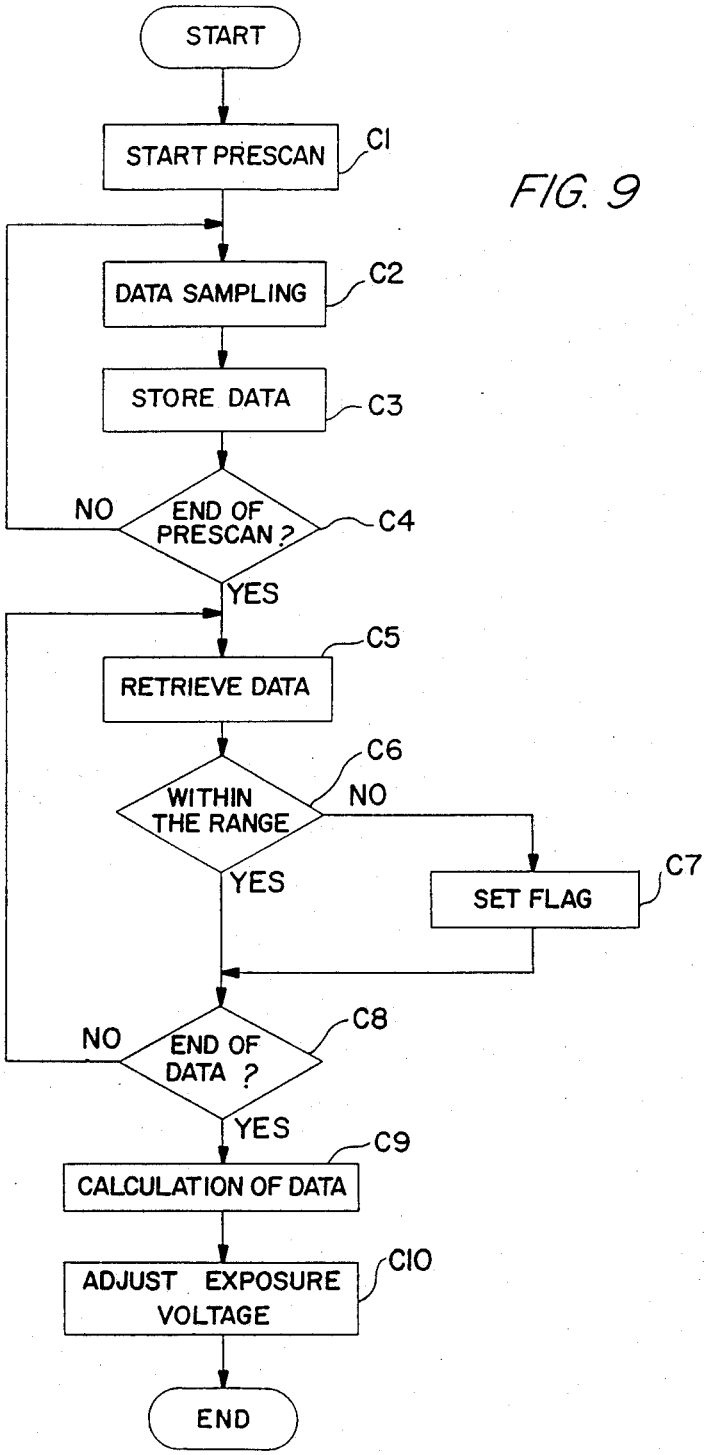
FIG. 9 is a flow chart of the prescanning process of a further embodiment of the invention.
Figure 11A:
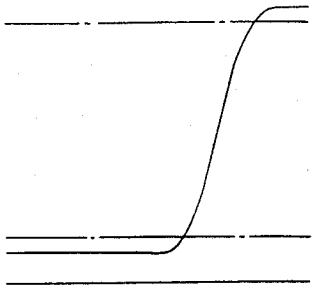
FIG. 11(A) shows an example of the output variation of a photosensor.
Figure 11B:
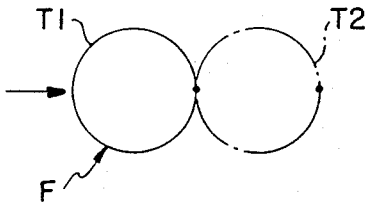
FIG. 11(B) shows the light receiving surface of the photosensor.
Figure 11C:
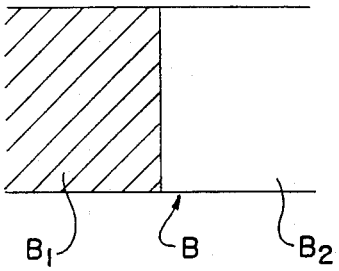
FIG. 11(C) shows an original for obtaining the output of FIG. 11(A)
Figure 10:
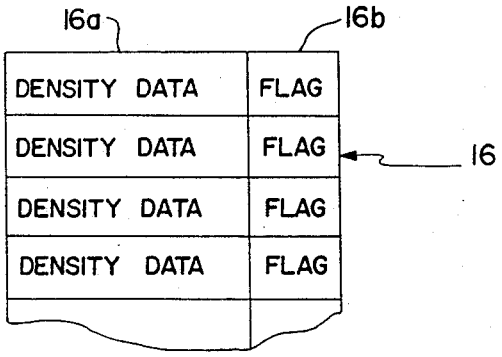
FIG. 10 shows schematically the RAM of the embodiment of FIG. 9.
Figure 12A:
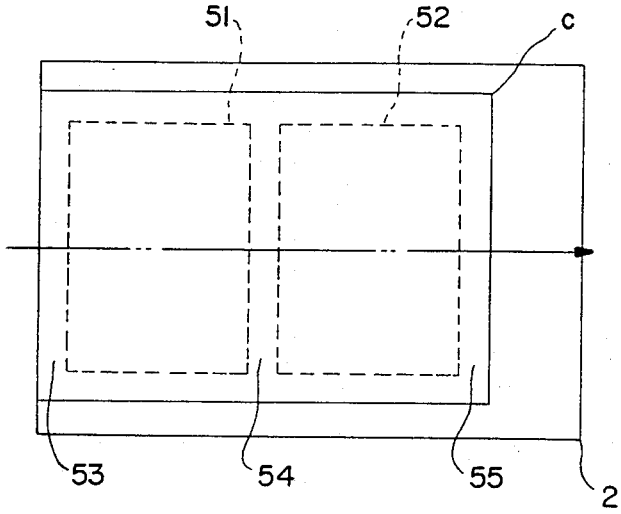
FIG. 12(A) is a diagram illustrating a manner of placing another original on an original table.
Figure 12B:
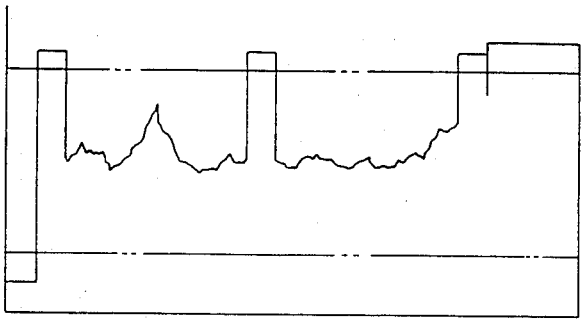
FIG. 12(B) shows an example of the actual density variation of the original of FIG. 12(A)
Figure 12C:
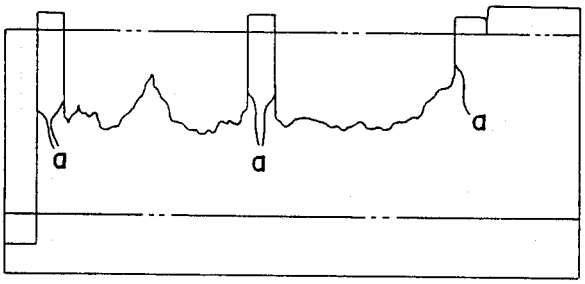
FIG. 12(C) shows the density data of the original of FIG. 12(A) detected by a conventional copying apparatus.

FIG. 9 is a flow chart of the prescanning process in a third embodiment of the invention. In this embodiment, the RAM 16 has storage areas 16*a* for density data and flag areas 16*b* which correspond respectively to the storage areas 16*a*, as shown in FIG. 10.

When an original to be copied is placed on the original table 2 and the copy button is depressed, a scanning unit starts to move for prescanning (step C1). The density data of the original is sampled at a specified time interval (step C2), and stored sequentially in the storage areas 16*a* (step C3). When the scanning unit has moved over the original, it returns to the home position (step C4). Then, the stored density data is retrieved for density data (data obtained from white areas) which are greater than a predetermined upper threshold value and also for density data (data obtained from black areas) which are smaller than a predetermined lower threshold value (step C5). In step C7, a flag is set in the flag areas 16*b* corresponding to the areas 16*a* storing the extreme density data obtained from white and black areas and also to the areas 16*a* storing density data which have been obtained within a predetermined time period (for example, 60 ms) from the time when each of those extreme density data has been obtained. Then, in steps C9 and C10, the level of the exposure voltage is adjusted on the basis of density data which are obtained by excluding the data to which flags are set from the data obtained in step C3. The above-mentioned upper and lower threshold values may be preset in the same manner as described in Example 2.

In this specification, the invention has been described by illustrating embodiments in the form of a copying apparatus. However, the invention is not restricted to a copying machine but also applicable to other image forming apparatus and image reading apparatus such as an image scanner.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A copying apparatus comprising:
   - a density detection device for detecting the density of an original to be copied, in a process of prescanning the original;
   - adjusting means for adjusting at least one of the conditions of copying the original, on the basis of a group of detected density data; and
   - correction means for eliminating the data obtained from a portion of a predetermined color from said group of detected density data.

2. A copying apparatus according to claim 1, wherein said predetermined color is black.

3. A copying apparatus comprising:
   - a density detection device for detecting the density of an original to be copied, in a process of prescanning the original;
   - adjusting means for adjusting at least one of the conditions of copying the original, on the basis of the group of detected density data which exist between two predetermined values;
   - detection means for detecting the density of a first reference original having a dark color and the density of a second reference original having a bright color; and
   - density storage means for storing said two densities detected by said detection means as said two predetermined values.

4. A copying apparatus comprising:
   - a density detection device for detecting the density of an original to be copied, in a process of prescanning the original;
   - adjusting means for adjusting at least one of the conditions of copying the original, on the basis of a group of detected density data;
   - judging means for judging whether density data obtained from portions of the original exist between two predetermined values or not; and
   - correction means for eliminating, from said group of detected density data, extreme density data which exist beyond the range between said two predetermined values.

5. An apparatus according to claim 4, wherein said correction means further eliminates density data which is obtained during a predetermined time period including the time when each of said extreme density data is obtained.

6. An image reading apparatus comprising:

a density detection device for detecting the density of an image to be read, in a process of prescanning the image;

adjusting means for adjusting at least one of the conditions of reading the image, on the basis of a group of detected density data; and correction means for eliminating the data obtained from a portion of a predetermined color, from detected density data.

7. An image reading apparatus according to claim 6, wherein said predetermined color is black.

8. An image reading apparatus comprising:

a density detection device for detecting the density of an image to be read, in a process of prescanning the image;

adjusting means for adjusting at least one of the conditions of reading the image, on the basis of a group of detected density data which exist between two predetermined values;

detection means for detecting the density of a first reference image having a dark color and the density of a second reference image having a bright color; and density storage means for storing said two densities detected by said detection means as said two predetermined values.

9. An image reading apparatus comprising:

a density detection device for detecting the density of an image to be read, in a process of prescanning the image;

adjusting means for adjusting at least one of the conditions of reading the image, on the basis of a group of detected density data;

judging means for judging whether density data obtained from portions of the image exist between two predetermined values or not; and correction means for eliminating, from said group of detected density data, extreme density data which exist beyond the range between said two predetermined values.

10. An apparatus according to claim 9, wherein said correction means further eliminates density data which is obtained during a predetermined time period including the time when each of said extreme density data is obtained.

* * * * *